US006874965B1

(12) United States Patent
Mondloch et al.

(10) Patent No.: US 6,874,965 B1
(45) Date of Patent: Apr. 5, 2005

(54) DRYWALL FINISHING HEAD WITH TENSIONER ASSEMBLY

(75) Inventors: Steven J. Mondloch, Kaukauna, WI (US); Jeffrey L. Denkins, Kaukauna, WI (US)

(73) Assignee: APLA-TECH, Inc., Kaukauna, WI (US)

( * ) Notice: Subject to any disclaimer, the term of this patent is extended or adjusted under 35 U.S.C. 154(b) by 0 days.

(21) Appl. No.: 10/610,459

(22) Filed: Jun. 30, 2003

Related U.S. Application Data

(60) Provisional application No. 60/393,764, filed on Jul. 3, 2002.

(51) Int. Cl.[7] ..... B05C 11/10

(52) U.S. Cl. ..... 401/5; 15/235.3; 156/574; 156/575; 425/87; 401/48; 401/138; 401/139; 401/266

(58) Field of Search ..... 401/119, 121, 131, 401/138, 139, 137, 140, 266, 265, 261, 5, 401/48; 15/235.3; 425/87; 156/574, 575, 156/577, 578

(56) References Cited

U.S. PATENT DOCUMENTS

| | | | | |
|---|---|---|---|---|
| 4,208,239 | A * | 6/1980 | Lass | 156/575 |
| 4,516,868 | A * | 5/1985 | Molnar | 425/87 X |
| 5,122,006 | A * | 6/1992 | MacMillan | 425/87 X |
| 6,733,262 | B1 * | 5/2004 | Denkins | 425/87 |
| 2001/0003563 | A1 * | 6/2001 | Schauer et al. | 401/266 X |

* cited by examiner

*Primary Examiner*—Gregory L. Huson
*Assistant Examiner*—Kathleen J. Prunner
(74) *Attorney, Agent, or Firm*—Andrus, Sceales, Starke & Sawall, LLP

(57) ABSTRACT

A drywall finishing head is provided for applying mastic material over a tape joint between adjacent wallboard surfaces. The finishing head includes a coater connected to a pneumatic applicator for delivering the mastic material. A wiper blade extends across the length of the coater with a cover underlying the wiper blade and a backer bar overlying the wiper blade. A cam assembly is rotatably mounted on a tensioning portion of the coater. Adjustment of the cam assembly is constructed and arranged to change the force of the backer boar so that a proper crown or profile of mastic material can be delivered to the tape joint through a gap between the cover and the wiper blade.

10 Claims, 3 Drawing Sheets

FIG. 1
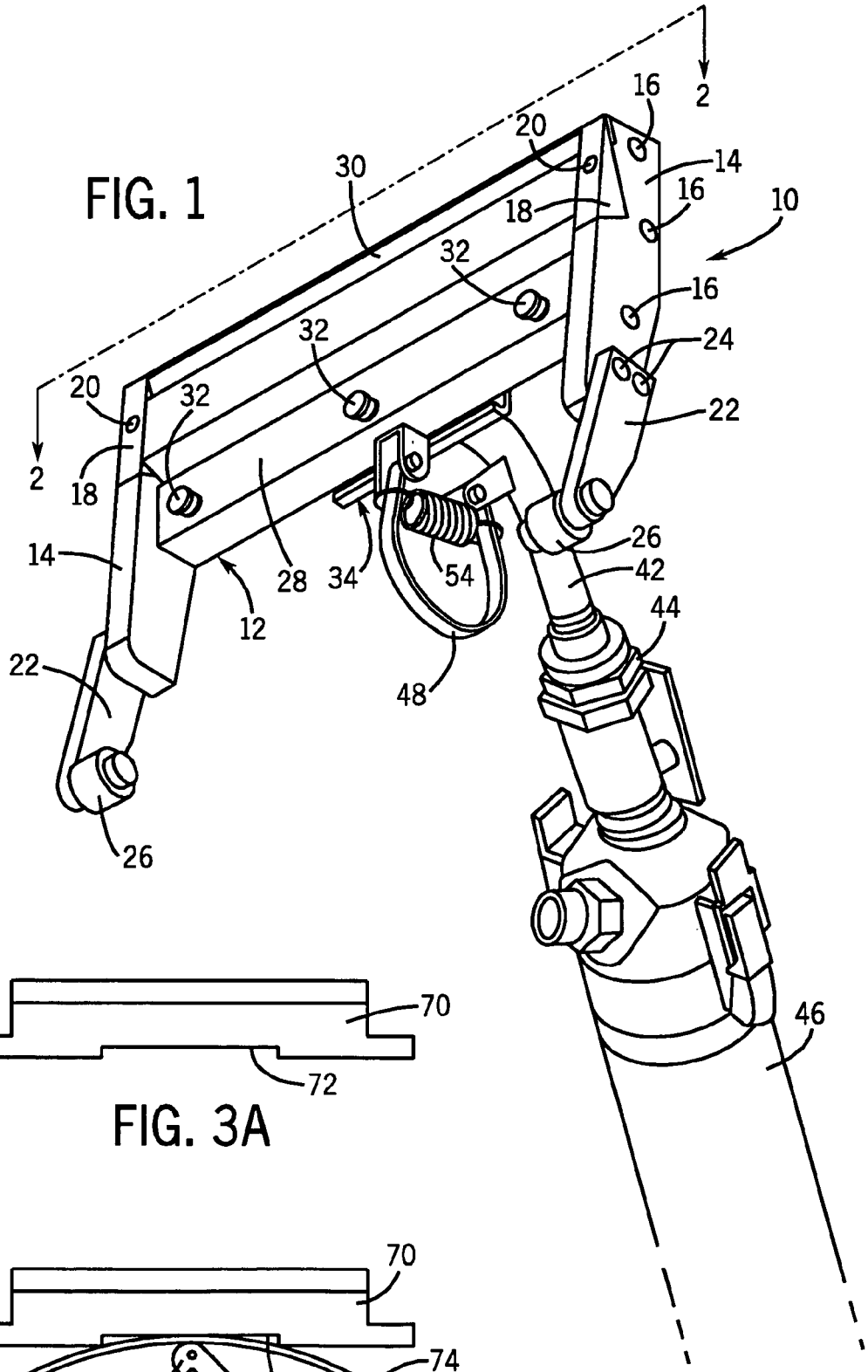
FIG. 3A
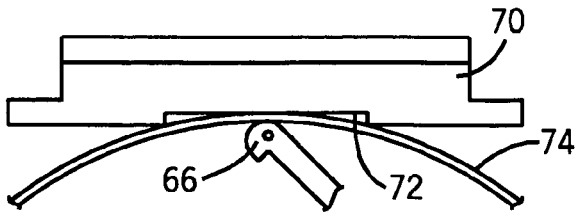
FIG. 3B

DRYWALL FINISHING HEAD WITH TENSIONER ASSEMBLY

CROSS REFERENCE TO RELATED APPLICATION

This application is related to provisional application U.S. Ser. No. 60/393,764 filed Jul. 3, 2002.

FIELD OF THE INVENTION

The present invention relates generally to finishing tools or coaters for applying mastic material, drywall compound or other similar material over tape joints between adjacent pieces of wallboard. More particularly, the present invention is directed towards a coater having a tensioner assembly which provides improved control for adjustably applying the proper amount of mastic over the taped joint.

BACKGROUND OF THE INVENTION

Wallboard or drywall has become the dominant material in the production of interior building partitions. In particular, interior building partitions generally comprise a series of spaced vertical studs which are used as support for pre-formed wallboards which are attached to the studs by the screws, nails, adhesive or the like. Typically, a paper or fiberglass tape is applied to the joint between adjacent wallboard panels. In order to provide a continuous flat surface to the wall, it is necessary to "finish" the tape joint between adjacent panels. Generally such "finishing" entails the building up or accumulation of multiple layers of mastic material over the taped joint. During the finishing process, it is important that the proper crown or profile of mastic material is applied given the amount of shrinkage that occurs when each coat of mastic material dries. Crown control is dependent upon several variables including coat thickness and the amount of water mixed in the drywall compound.

Drywall heads for applying mastic compound to finish drywall joints are known in the art. Precision Taping Tools of Arthur, Ill. produces a coater (model K-520A, K-530A, K-540A) with a flat finishing head formed with a coater body having side plates and skids or arm links adapted to engage a wall during mastic application. One wall of the coater body has a mounting plate which rotatably receives a ball member connected to a hollow arm member which allows mastic material to be moved from a pneumatic applicator to the flat finishing head. A C-spring has one end secured to a clevis integrally formed on the arm member, and another end joined to a rotatable clevis on the mounting plate. The coater body also includes a bottom cover plate, a wiper blade and a generally flat backer bar. A cam lever acts against a tensioner wire having L-shaped ends which contact the backer bar at two points. Mastic material delivered through the ball member to the interior of the coater body is controllably squeezed through a gap defined between the cover and the blade. The cam and tensioner wire are used to control the crown or profile of mastic material delivered from the finishing head.

When using the Precision Taping Tool coater, the flat backer bar relies on the viscosity of the drywall compound, the setting of the cam tensioner wire and the deflection of the cam tensioner wire/backer bar to provide the desired mastic profile. In addition, the prior art coater uses a cam having a half-round profile with an offset pivot to provide adjustability. However, as the cam moves through its travel, it reaches a point where a small adjustment of the cam lever makes abnormally large adjustments of the backer bar/blade and vice versa. In some occasions, the prior art finishing head deflects so far as to overcrown the compound making a subsequent coat "near to impossible" without scraping or sanding the joint. Further, the prior art finishing head has its cam tension or wire contacting the backer bar at two points which sometimes allows three crowns to form instead of one. It has also been established that the prior art coater does not return to its starting position each time it is lifted off the wall. It is further noted that the prior art coater skids are subject to excessive sliding friction and wear as they are drawn over the wallboard.

Accordingly, it is desirable to provide a drywall finishing head having an adjustment arrangement for enabling a greater predictability of crown or profile of mastic material delivered to the tape joint. It is also desirable to provide a drywall finishing head which moves along the wallboard with less friction and wear, and which returns to a start position each time it is lifted off the wallboard.

SUMMARY OF THE INVENTION

It is one object of the present invention to provide a drywall finishing head for applying mastic compound which may be used with a pneumatically-actuated storage body for providing a controllable flow of mastic material over a tape joint between adjacent wallboard panels.

It is also an object of the present invention to provide a drywall finishing head having a backer bar, a cam and a cam follower plate uniquely designed to provide the desired crown of mastic compound to the tapered wallboard joint.

It is another object of the present invention to provide a drywall finishing head which may be operated with arm links off the surface of the wallboards.

In one aspect of the invention, a drywall finishing head is provided for applying mastic material over a tape joint between adjacent wallboard surfaces. A coater body has a retaining assembly attached thereto for movably receiving a ball connected via an arm to a storage body for delivering mastic material through an opening in the wall to a mastic chamber in the coater body. A wiper blade extends substantially across a length of the coater body. A cover underlies the wiper blade and also extends substantially across the length of the coater body. A curved backer bar extends substantially across the length of the coater body and overlies the wiper blade. A cam assembly includes an elliptical cam rotatably mounted on the retaining assembly and acts against a cam tensioner plate fixed behind the cam. The cam further acts on a tensioner wire having a central portion extending behind the retaining assembly and end portions wrapped around the front of the retaining assembly. The wire contacts a cam follower plate engageable with the backer bar. Adjustment of the cam assembly is constructed and arranged to change the force on the backer bar so that a proper crown or profile of mastic material can be delivered to the tape joint through a gap between the cover and the wiper blade.

The coater body includes a pair of side plates to which a pair of arm links is attached, the arm links carrying a set of wheels rotatably mounted thereto and adapted to rollably engage a wallboard surface with reduced friction. A C-shaped spring has one end attached to the arm and another end attached to the ball retainer/tensioner assembly, there being an auxiliary coil spring connected between the ends of the C-shaped spring. A baffle is secured to the coater body, the baffle having a curved bottom end receiving a lower end of the wiper blade. The curved bottom end of the baffle and the cover define a restricted passage for receiving mastic material in the mastic chamber of the coater body and allowing the mastic material to pass to the gap between the cover and the wiper blade. The cam follower plate is formed with a groove having a width and a depth, the walls of the groove being engageable with the tensioner wire. The backer bar has a spring rate controlled by the width of the groove in the cam follower plate. The amount of deflection in the wiper blade is limited by the depth of the groove in the cam follower plate. The cam is moveable between a full crown setting in which the cam is out of contact with the tensioner wire and mastic material is delivered through the gap in a crown profile over the tape joint, and a full flat setting in which the cam engages the tensioner wire and mastic material is delivered through the gap in a flat profile over the tape joint.

The invention further contemplates a drywall finishing tool having a coater body provided with a cover, a wiper blade and a backer bar, and a cam acting against a tensioner wire to move the backer bar so that mastic material is controllably squeezed between a gap between the cover and the blade. The invention is improved wherein the cam is an elliptical cam rotatably mounted on a retaining assembly attached to the coater body and acting against a cam tensioner plate fixed behind the cam. The cam further acts on a tensioner wire having a central portion extending behind the retaining assembly and end portions wrapped around a front of the retaining assembly. The wire contacts a cam follower plate engageable with a curved backer bar.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a drywall finishing head for applying mastic material to a taped wallboard joint;

FIG. 3A is an elevational view of a cam follower plate used in the cam assembly;

FIG. 3B is a view of the cam acting against a cam tensioner wire and the cam follower plate;

DETAILED DESCRIPTION OF THE INVENTION

Figure 2:
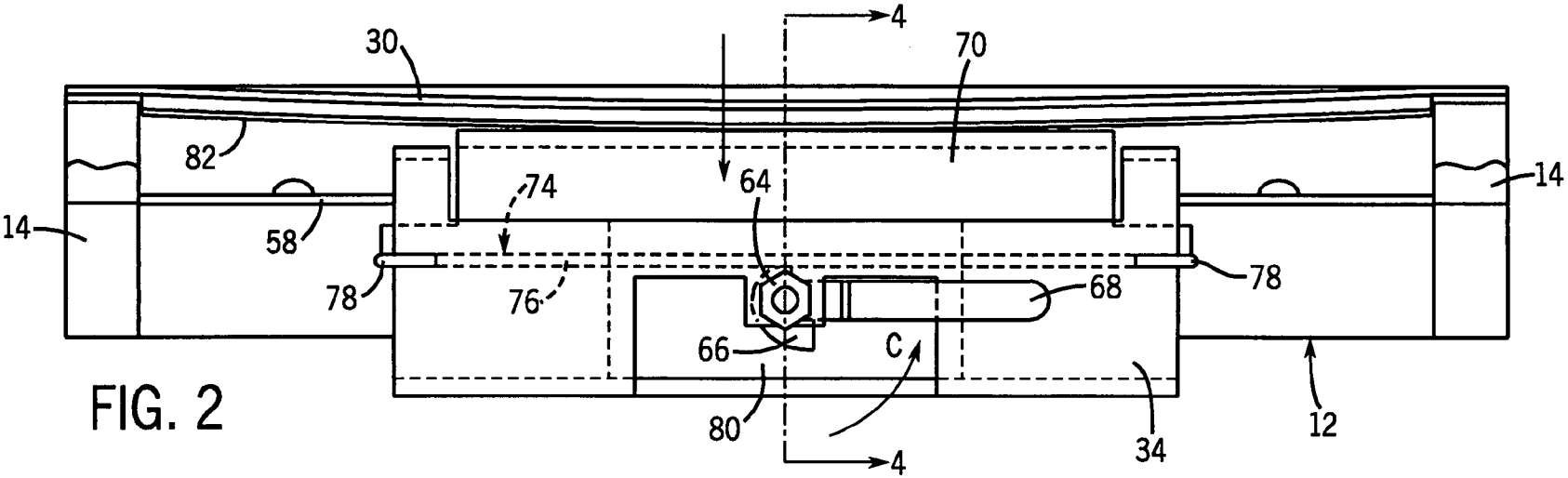
FIG. 2 is an end view taken along line 2—2 of FIG. 1 showing a cam assembly for the finishing head in a full crown setting.

Referring now to the drawings, FIG. 1 illustrates a drywall finishing head 10 embodying the present invention. The drywall finishing head or coater 10 has a generally rectangular coater body 12 with a pair of side plates 14 fixed by fasteners 16. A pair of generally triangular shaped shoes 18 are joined to the side plates 14 by fasteners 20. Extending downwardly from the side plates 14 is a pair of arm links 22 which are connected by fasteners 24. The lowermost ends of the links 22 are equipped with a pair of inwardly directed, rotatable wheels 26 which are adapted to rollably engage a wallboard 56 and reduce friction as the head 10 is drawn downward along the wallboard 56. The coater 10 also includes a bent cover 28 which overlies a wiper blade 30 and is removably joined to the coater body 12 by thumbscrews 32. The cover 28 may be removed as desired to enable cleaning of the finishing head 10. Attached to the other side of the coater body 12 is a retaining assembly 34.

Figure 4:
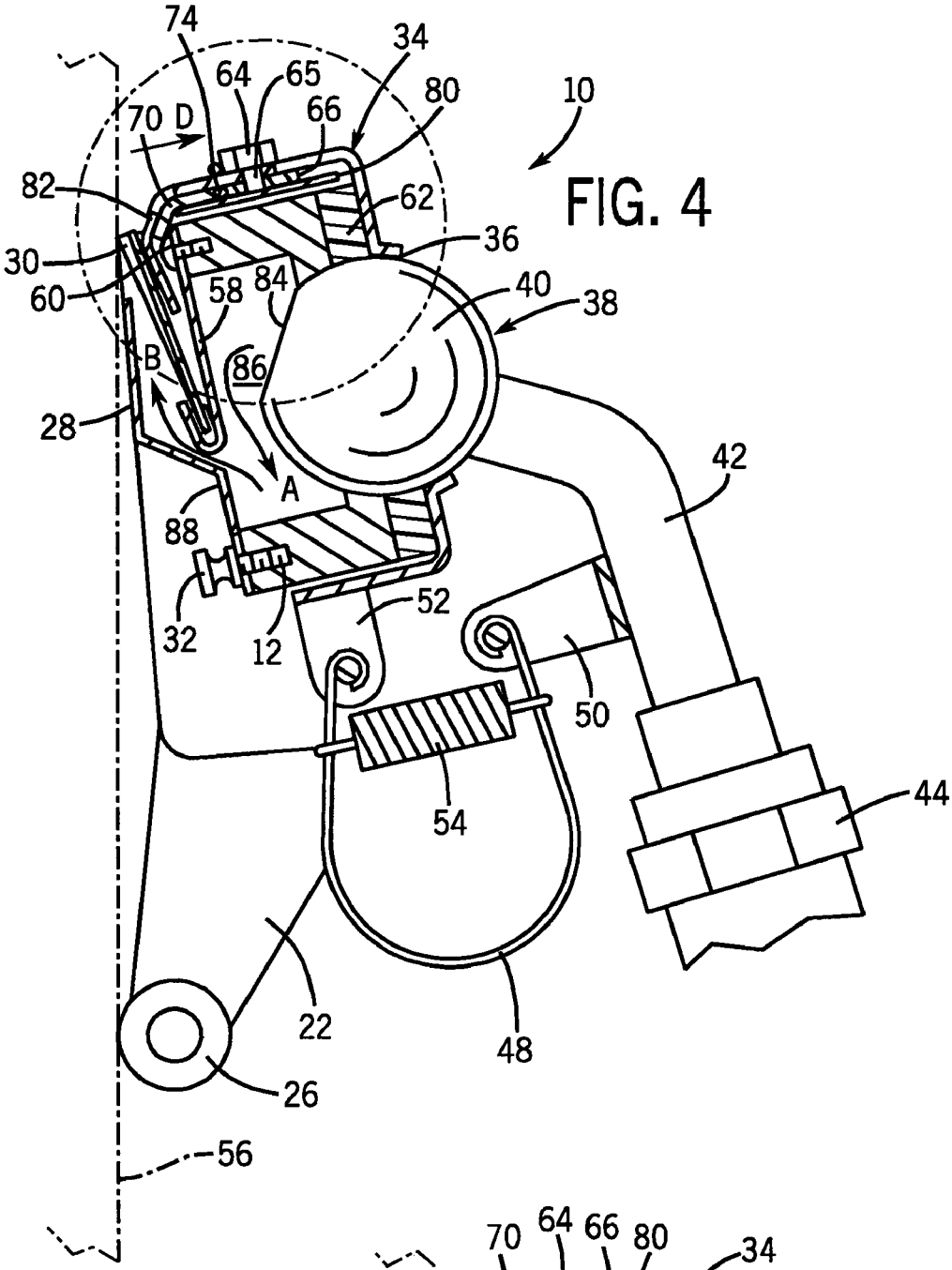
FIG. 4 is a partial sectional view of the drywall finishing head as applied along a wallboard and corresponding to the full crown setting.

Referring now to FIG. 4, the retaining assembly 34 includes a spherical cavity or ball socket 36 designed for movably receiving a ball assembly 38. The ball assembly 38 consists of an apertured ball member 40 designed to fit into the socket 36, a curved arm member or goose neck 42 and a coupling member 44. The goose neck 42 has a hollow interior that allows mastic material to be moved from a pneumatically-actuated storage body 46 to the finishing head 10. The goose neck 42 is curved so the head 10 may be parallel to the wallboard while a user is holding the storage body 46 at an angle to the wallboard 56 and head 10. The coupling member 44 is designed to attach the finishing head 10 to the storage body 46.

Figure 3:
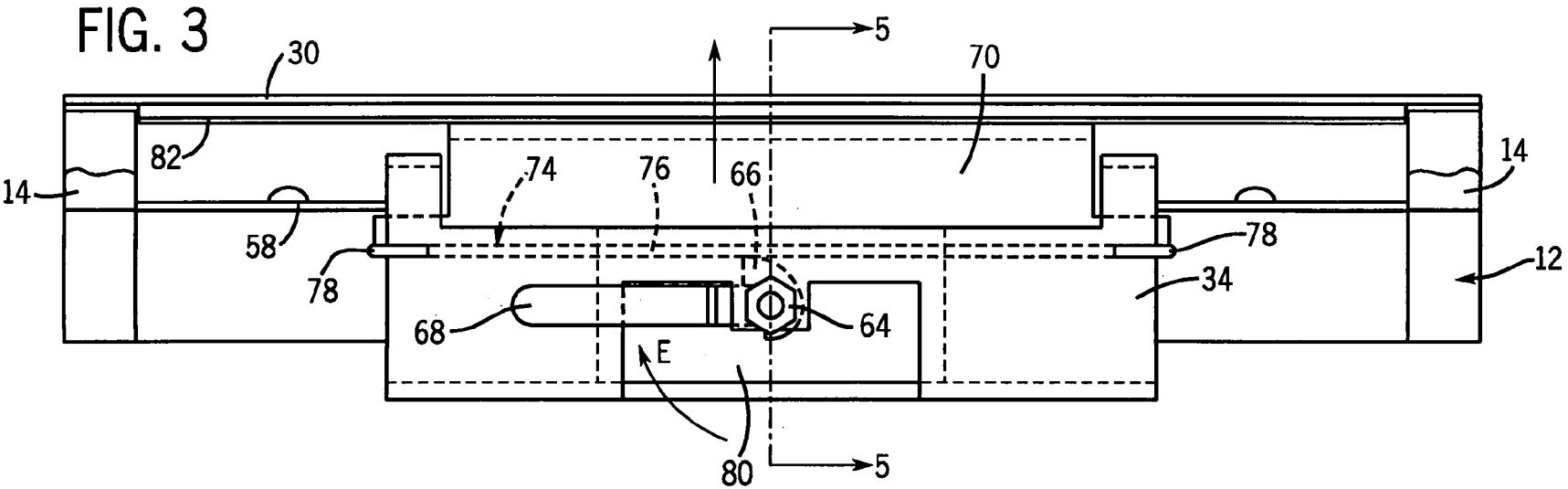
FIG. 3 is a view similar to FIG. 2 showing the cam assembly in a full flat setting.

A C-shaped knee spring 48 has one end pivotally connected to a fixed clevis 50 extending from the goose neck 42, and another end pivotally formed to a fixed clevis 52 integrally formed on the retaining assembly 34. An auxiliary coil spring 54 is connected between the ends of the knee spring 48. During operation of the storage body 46 and finishing head 10, the knee spring 48 biases the head into a known orientation as illustrated in FIG. 4. Thus, when the drywall head 10 is removed from the wallboard 56, the head 10 returns to the position shown in FIG. 4. The auxiliary spring 54 supplements the knee spring 48 to allow finishers the ability to operate the coater 10 with the wheels 26 off the wallboard 56. This is necessary, for example, when coating to the edge of a window opening or when the wheels 26 would contact and make tracks in another nearby wet joint. Referring now to FIGS. 2, 3 and 4, the coater 10 further includes an inner baffle 58 which is J-shaped in cross section (FIG. 4) and has a top end secured to the coater body 12 by fasteners 60. A bottom end of the blade 30 is retained in the curved bottom of the inner baffle 58. A spacer and shim assembly 62 to provide a precise relationship between the retaining assembly 34 and a backer bar/blade assembly to be described is interposed between the coater body 12 and the retaining assembly 34 and surrounds the ball member 40.

A cam assembly for the finishing head 10 will now be described. A nut 64 has a shaft 65 which is screw threaded into the ball retainer/tensioner assembly 34 and provides a mounting surface for an elliptically shaped cam 66 having a cam lever 68. A cam follower plate 70 is formed with a groove 72 as shown in FIGS. 3A and 3B. The cam 66 acts against a cam tensioner wire 74 having a central section 76 which runs behind the retaining assembly 34 and lies adjacent the top of the cam follower plate 70 as seen in FIG. 3B. Cam tensioner wire 74 acts against the cam follower plate 70. The ends 78 of the cam tensioner wire 74 are bent around the ends of the retaining assembly 34. Underlying the central portion 76 of the cam tensioner wire 74 is a cam tension plate 80 which may be fixed to the nut shaft 65. The tensioner wire 74 contacts the cam follower plate 70 which, in turn, acts against a curved backer bar 82 which with the wiper blade 30 extends across substantially the entire length of the coater body 12.

In operation, the coater 10 is placed over a taped joint at the topmost end thereof. As best seen in FIG. 4, mastic compound is delivered from the storage body 46 through the goose neck 42 and aperture 84 in the ball member 40 into a mastic chamber 86 in the coater body 12. Mastic material moves in the direction of the Arrow A and travels through the opening between the bottom of the inner baffle 58 and the bend 88 in the cover 28. Mastic material continues to travel in the direction of Arrow B until it is dispersed from the gap between the cover 28 and the wiper blade 30. The head 10 is moved over the tape joint from top to bottom delivering the desired crown. Most joints require multiple coats so that progressively larger coater heads 10 are used to finish the tape joint.

FIG. 4 shows the finishing head 10 in a full crown setting as shown in FIG. 2 wherein the cam lever 68 is pivoted in the direction of Arrow C. The elliptical cam 66 is out of contact with the tensioning wire 74 and the cam follower plate 70 is retracted as depicted by Arrow D in FIG. 4 so that the backer bar 82 and wiper blade 30 are bowed. Mastic material is delivered through the gap in a convex profile over the tape joint.

Figure 5:
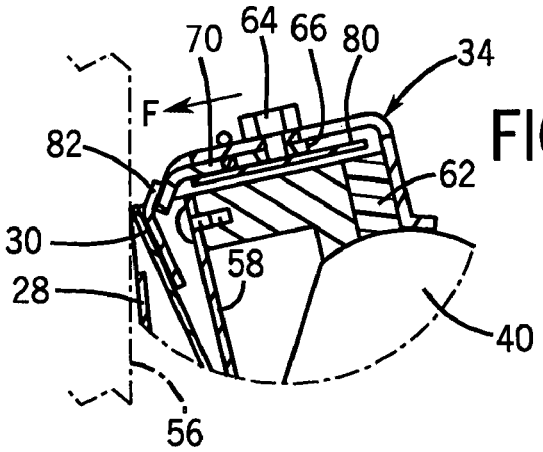
FIG. 5 is a view similar to FIG. 4 showing the drywall finishing head in the full flat setting.

FIG. 5 shows the finishing head 10 in a full flat setting as shown in FIG. 3 wherein the cam lever 68 is pivoted in the direction of Arrow E. As the cam lever 68 is shifted, the elliptical cam 66 engages and deflects the tensioner wire 74 (FIG. 3B) thereby pushing the cam follower plate 70 in the direction of Arrow F (FIG. 5). Pushing the cam follower plate 70 causes the backer bar 82 to move against the wiper blade 30. As a result, the amount of mastic material delivered to the gap is reduced to a flat profile over the tape joint. Obviously, the cam lever 68 may be positioned over 180 degrees to determine the amount of crown (profile) to be delivered from the finishing head 10.

It has been discovered that forming the backer bar 82 with a curved surface enhances control over the desired crown (profile) of the mastic material whereas the prior art flat backer bar relies on the viscosity of the mastic compound, the setting of the cam tensioner and the deflection of the cam tensioner. In addition, elliptical profile of the cam 66 of the present invention provides a constant change of crown as compared with the prior art half rounded cam with offset pivot wherein a small adjustment of the cam lever makes abnormally large adjustments of the backer bar and blade. In the present design, the spring rate of the backer bar 82 is controlled by the width of the groove 72 in the cam follower plate 70. A wider groove 72 provides a lower (softer) spring rate than a narrow one. The prior art finishing head does not provide for this. The amount of blade deflection is limited by the depth of the groove 72 in the cam follower plate. This provides control over the profile of the compound yet allows the blade to deflect slightly if it hits something solid without lifting the outer edges of the coater off the wall. The prior art system would deflect so far as to overcrown the compound making a subsequent coat "near to impossible" without scraping or sanding the joint. In the finishing head 10 described herein, the bottom of the cam follower plate 70 provides springable support for the backer bar 82. The prior art device has the cam tensioner wire contacting the backer bar at two points which can result in formation of three crowns instead of one. As mentioned previously, the mounting of the knee spring 48 provides a return position for the coater head 10. The addition of the auxiliary spring 54 provides finishers with the ability to operate the coater 10 with the wheels 26 off the surface of the wallboard 56. In the present head 10, the U-shaped tensioner wire 74 increases the force applied to the backer bar 82 so that the proper crown could be achieved on each of the coats. Crown control is necessary because of the amount of shrinkage that occurs when each coat dries. Further, the cam adjuster is shimable to allow for setting the relaxed convex travel of the blade 30 whereas the only adjustment in the prior art head is to bend the tensioner spring.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention as set forth with the following claims.

We claim:

1. A drywall finishing head for applying a mastic material over a tape joint between adjacent wallboard surfaces comprising:

a coater having a body and a retaining assembly attached thereto for movably receiving a ball connected via an arm to a storage body for delivering mastic material through an opening in the ball to a mastic chamber in the coater body;

a wiper blade extending substantially across a length of the coater body;

a cover underlying the wiper blade and extending substantially across the length of the coater body;

a curved backer bar extending substantially across the length of the coater body and overlying the wiper blade; and a cam assembly including an elliptical cam rotatably mounted on the retaining assembly and acting against a cam tensioner plate fixed behind the cam, the cam further acting on a tensioner wire having a central portion extending behind the retaining assembly and end portions wrapped around a front of the retaining assembly, the wire contacting a cam follower plate engageable with the backer bar, whereby adjustment of the cam assembly is constructed and arranged to change the force on the backer bar so that a proper crown or profile of mastic material can be delivered to the tape joint through a gap between the cover and the wiper blade.

2. The drywall finishing head of claim 1, wherein the coater body includes a pair of side plates to which a pair of arm links is attached, the arm links carrying a set of wheels rotatably mounted thereto and adapted to rollably engage a wallboard surface with reduced friction.

3. The drywall finishing head of claim 1, wherein a C-shaped spring has one end attached to the arm and another end attached to the retaining assembly, there being an auxiliary coil spring connected between the ends of the C-shaped spring.

4. The drywall finishing head of claim 1, wherein a baffle is secured to the coater body, the baffle having a curved bottom end receiving a lower end of the wiper blade.

5. The drywall finishing tool of claim 4, wherein the curved bottom end of the baffle and the cover define a restricted passage for receiving mastic material in the mastic chamber of the coater body and allowing the mastic material to pass to the gap between the cover and the wiper blade.

6. The drywall finishing tool of claim 1, wherein the cam follower plate is formed with a groove having a width and a depth, the walls of the groove being engageable with the tensioning wire.

7. The drywall finishing tool of claim 6, wherein the backer bar has a spring rate controlled by the width of the groove in the cam follower plate.

8. The drywall finishing tool of claim 7, wherein the amount of deflection in the wiper blade is limited by the depth of the groove in the cam follower plate.

9. The drywall finishing head of claim 1, wherein the cam is movable between a full crown setting in which the cam is out of contact with the tensioning wire and mastic material is delivered through the gap in a crown profile over the tape joint, and a full flat setting in which the cam engages the tensioning wire and mastic material is delivered through the gap in a flat profile over the tape joint.

10. In a drywall finishing tool having a coater body provided with a cover, a wiper blade and a backer bar, and a cam acting against a tensioning wire to move the backer bar so that mastic material is controllably squeezed between a gap between the cover and the blade, the improvement wherein;

the cam is an elliptical cam rotatably mounted on a retaining assembly attached to the coater body and acting against a cam tensioning plate fixed behind the cam, the cam further acting on the tensioning wire having a central portion extending behind the retaining assembly and end portions wrapped around a front of the retaining assembly, the tensioning wire contacting a cam follower plate engageable with the backer bar which is curved.

* * * * *